United States Patent [19]

Christie et al.

[11] Patent Number: 4,494,962

[45] Date of Patent: Jan. 22, 1985

[54] FUEL PRODUCT

[76] Inventors: George M. Christie, 33 Claude, Beaconsfield, Quebec, Canada, H9W 4E9; James M. Holmes, 60 Grove Ave., Ottawa, Ontario, Canada, K15 3A8

[21] Appl. No.: 444,356

[22] Filed: Nov. 24, 1982

[51] Int. Cl.[3] ..... C10L 5/14; C10L 5/36

[52] U.S. Cl. ..... 44/15 D; 44/10 A; 44/10 L; 44/14; 44/16 C

[58] Field of Search ..... 44/10 A, 10 B, 10 R, 44/15 D, 16 C, 26, 4 D, 14, 10 F, 10 G, 10 L, 10 J, 16 E, 1 D

[56] References Cited

U.S. PATENT DOCUMENTS

| | | | |
|---|---|---|---|
| 379,490 | 3/1888 | Owen | 44/10 A |
| 1,454,410 | 5/1923 | Robison | 44/10 A |
| 2,789,890 | 4/1957 | Stevens | 44/40 |
| 4,120,666 | 10/1978 | Lange | 44/14 X |
| 4,259,085 | 3/1981 | Ban et al. | 44/26 |

FOREIGN PATENT DOCUMENTS

| | | | |
|---|---|---|---|
| 3013120 | 10/1981 | Fed. Rep. of Germany | 44/1 D |
| 15439 | of 1914 | United Kingdom | 44/15 D |

*Primary Examiner*—Carl F. Dees

[57] ABSTRACT

A coal fines log comprising a composite log made of a mixture of 90 to 98% coal particles having a size of roughly 10 microns, the log also containing paper and other cellulosic fibers such as bark in the range of 2 to 10% and grounded limestone is also provided in the log to neutralize the sulfur dioxide while burning. The log is contained in a hermetically sealed polyethylene envelope, the product so-formed is readily ignited and can sustain combustion over a relatively long period of time.

2 Claims, 2 Drawing Figures

FUEL PRODUCT

BACKGROUND OF THE INVENTION

1. Field of the Invention

The present invention relates to improvements in fuels, and more particularly to an improved coal fuel product and a method for producing it.

2. Description of the Prior Art

With the ever increasing cost of petroleum fuels and dwindling oil reserves, the users of domestic and industrial fuels have been converting to alternative fuels. Such alternatives include natural gas, electricity, wood and coal. Natural gas, because of its gaseous state, is not readily transportable, and is therefore only practical for those users within easy access to a natural gas pipeline. Likewise, electricity is only a viable alternative when produced hydroelectrically. Otherwise, it must be produced using conventional fuels such as oil, nuclear or bituminous coal. Hydroelectric power is limited as to the distance from its source. Wood as fuel is presently limited to a cottage-trade distribution and can be expensive.

Coal, which is very abundant and relatively inexpensive, can be easily transported in bulk by rail. However, coal suffers from several disadvantages. Most coals have varying degrees of sulphur content. When burnt, coal gives off sulphur dioxide which combines with moisture in a chimney or smoke stack to produce sulphuric acid. This acid is released to the atmosphere and comes down as acid rain.

The best coal, that is, the cleanest having the higheset calorific value and lowest sulphur content, is anthracite coal. This coal, however, is also the most expensive, and the hardest to ignite (a disadvantage as a domestic fuel).

Furthermore, all coals are handled or distributed in a very inconvenient manner. It may be delivered by truck to one's home, but a bin must be provided to store up to 3 tons of briquettes of anywhere from pellet size (1 cm) to chunks of several centimeters in size. Coal is also dusty and dirty.

SUMMARY OF THE INVENTION

It is an aim of the present invention to provide coal as a fuel, suitable for domestic and commercial use, which overcomes many of the above disadvantages.

It is an aim of the present invention to utilize lower grade and thus cheaper coals, while neutralizing their sulphur content and presenting the coal fuel in a package which is clean and easily distributed and handled.

A fuel product in accordance with the present invention comprises a composite log consisting of a mixture of between 80% and 97% coal particles having a size of up to −4 mesh; cellulosic fibers in the range of 3% to 20%; ground limestone or hydrated lime particles in the range of 1% to 15% by weight; and a moisture content of less than 30%, the so-formed log being contained in a hermetically sealed envelope, with the envelope made of non-toxic combustible material.

In a more specific embodiment, the composite log consists of 90 to 94% coal particles and 6 to 10% used newsprint fibers and a supplement of 1% to 5% by weight of limestone is present in the mixture. The moisture content is 10% or less, and the hermetic envelope is made of polyethylene.

In another embodiment of the present invention, a composite log includes 90% of coal particles, 5% of shredded bark, preferably from conifer trees, and 5% of paper fibers, preferably of used newsprint, and a quantity of powdered limestone in an amount of 3% to 5% by weight.

More specifically, the bark utilized would be selected from a group including pine, spruce, balsam and hemlock. More specifically, the coal is a highly volatile bituminous coal and is preferably ground to a size of −8 mesh.

A method of making a composite fuel log in accordance with the present invention includes the steps of preparing a slurry of water and paper fibers, grinding coal to a mesh size of up to −4 mesh, adding the coal particles to the slurry to a proportion of between 3% and 20% paper fibers and 80% to 97% coal particles, mixing the slurry, adding powdered limestone to the slurry in an amount of 1% to 15% by weight, pouring the slurry into an open-ended mold, applying suction at least to the open end of the mold to reduce the water content to at least 25% moisture content, removing the so-formed log from the mold and drying the log to reduce the moisture content to below 10% moisture content and placing the log in a hermetically sealed envelope.

In a more specific version of the method in accordance with the present invention, the used paper fiber content is 6 to 10% and the coal particles are 94% while the limestone is added to an amount of 3% to 5% by weight thereof. The slurry is poured into a cylindrical mold, and a porous tube is inserted along the central axis of the cylindrical mold, and suction is applied through the porous tube to withdraw water from the so-formed log to below 50% moisture content, removing the porous tube therefrom, leaving a concentric cylindrical bore in the log, removing the log from the mold and drying the log to reduce the moisture content 10% or less and enveloping the so-formed log in a polyethylene envelope and hermetically sealing the envelope.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

In a specific example, 200 grams of newsprint was pulped in 3 liters of water by a 1 gallon Waring blender, a further 200 grams of shredded bark and 3 kilograms of coal were added into the slurry, and the heavy paste was beaten with a household mixer. The coal had been ground to 1 mm, and a bituminous coal from Minto, New Brunswick was selected. The slurry so formed was poured into a cylindrical mold, 12 inches in length and 5 inches in diameter. A one-and-a-half inch diameter "Porex" tube was inserted centrally of the cylinder, and suction was applied to the "Porex" tube for withdrawing water from the mold. When removed from the mold, the logs contained about 25% water.

The log was then air dried for one week in a laboratory with no application of external heat. Virtually, all of the water was removed in this matter.

The bark utilized was a mixture of spruce and pine bark from a lumber mill in Doaktown, New Brunswick. The bark was shredded in a laboratory Waring blender, then it was partially dried. It is contemplated that the bark can be successfully shredded by using a carding mill utilized for separating asbestos fibers and wool fibers. It has been found through experimentation that the fibrous material can be made solely from waste newspaper or with a mixture of newspaper and bark. However, the fibrous material cannot be composed solely of bark fibers. At least a small percentage of paper fiber is necessary in the mixture.

Most of the coals being utilized contain, as described previously, sulphur which, when burnt, will produce sulphur dioxide which can, upon contact with moisture, produce sulphuric acid or acid rain. In order to neutralize the sulphur, it has been found satisfactory to add crushed limestone in the slurry before being molded. The limestone can be in a ratio of up to 15% of the weight of the coal and fibers, but is preferably between 3% and 5% by weight. This apparently is sufficient to neutralize most of the sulphur in the coal when it is being burned.

The log described above was found to ignite quite readily and combustion was sustained. Other experiments have been made, and it has been found that a suitable size of log is of 4 inches in diameter and 15 inches in length with a central bore of 1 inch.

The polyethylene sealed envelope maintains the log dry and prevents the log from being in contact with oxygen which might cause spontaneous combustion.

Other examples of the log have been made using −8 mesh particle size in terms of the coal, and it has been found that these logs burn quite readily. The density of the logs has been found to be between 0.5 to 0.9 indicating that the logs are quite porous and, therefore, quite well adapted to sustain combustion.

Figure 1:
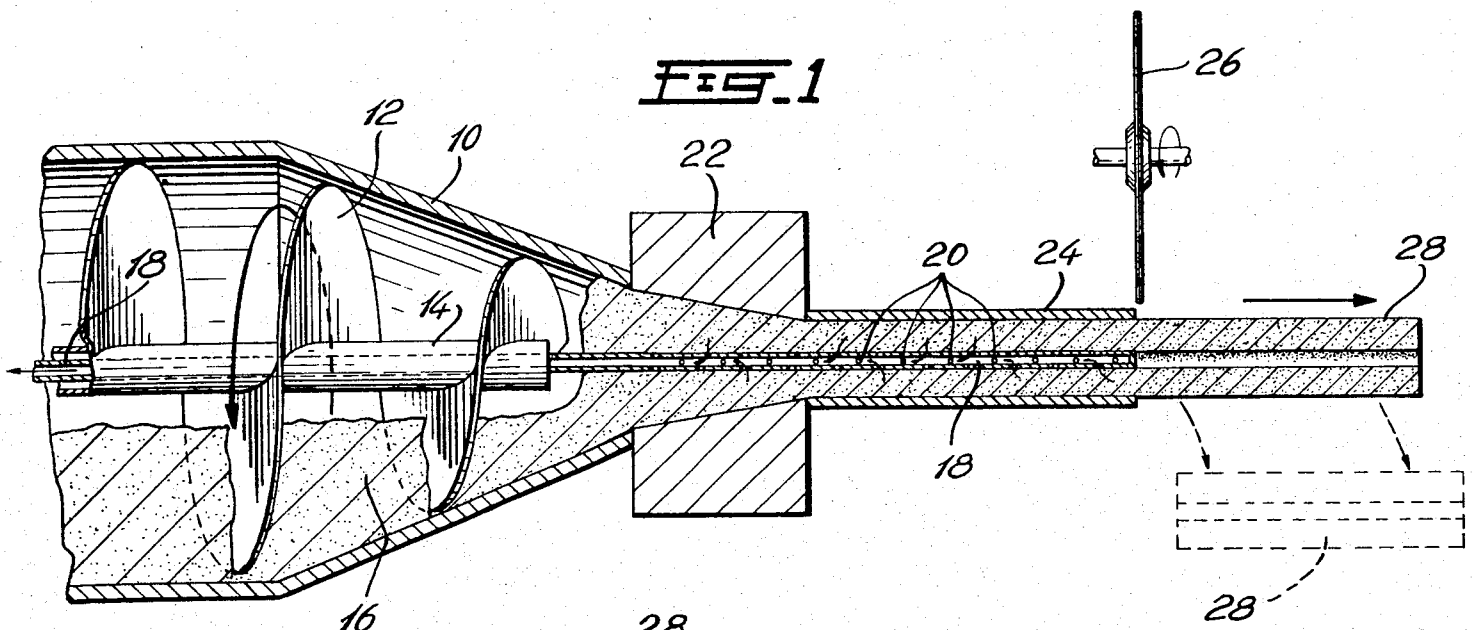
FIG. 1 is a schematic view of an embodiment of an apparatus for making logs in accordance with the present invention.
Figure 2:
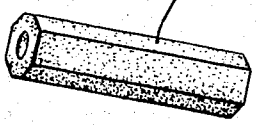
FIG. 2 is a perspective view of a coal log in accordance with the present invention.

A further embodiment for making the log is illustrated in FIG. 1. The apparatus shown in FIG. 1 is an extruder having a cone-shaped feeder 10 and a worm screw 12 on a shaft 14 for advancing the paste of coal and fibers 16. An elongated tube 18 having perforations 20 and being closed at one end is aligned concentrically with the shaft 14 and extends axially of the extruder. The tube 18 is connected to a suction pump, not shown. The extruder also includes a die 22 and a molding tube 24. A cutting saw 26 is provided at the end thereof for cutting predetermined lengths of the so-formed log 28.

As can be seen from the drawing, the paste of coal and fibers is advanced by the screw 12 through the die 22 and the molding tube 24 and is then cut off by the saw 26 into predetermined lengths. While the material is advancing in the die 22 and the tube 24, suction is applied so as to withdraw water from the so-formed log 28. The log 28 is then advanced on a conveyor for room temperature drying, and it can then be passed into a drying room to reduce the moisture content of the log to below 10%. The log is then packaged and shipped. It has been found that a preferred shape of the log is octagonal.

We claim:

1. A method of producing a composite fuel log comprising the steps of preparing a slurry of water and used newsprint paper fibers; grinding coal to a mesh size of between 10 microns and 3 mm; adding the coal particles to the slurry to a proportion of between 1% and 10% paper fibers and 90% to 98% coal particles; mixing the coal slurry; adding powdered limestone to the slurry in an amount of 1% to 10% by weight; pouring the slurry into an open ended mould; applying negative pressure at least to the open end of the mould to reduce the water content to at least 50% humidity; removing the so-formed log from the mould; and drying the log to reduce the moisture content below 30% humidity and placing the log in a hermetically sealed envelope.

2. A method as defined in claim 1, wherein the used newsprint paper fiber content is 6% and the coal particles is 94% while the limestone being added is an amount of 3% to 5% by weight, pouring the slurry into a cylindrical mould and inserting a porous tube along the central axis of the cylindrical mould and applying suction to the porous tube to withdraw water from the so-formed log to below 50% humidity, removing the porous tube therefrom thereby leaving a concentric cylindrical bore in the log, removing the log from the mould and drying the log to reduce a moisture content to below 10% and envelopping the so-formed log in a polyethylene envelope and hermetically sealing the envelope.

* * * * *